US007938888B2

(12) United States Patent
Assaf

(10) Patent No.: US 7,938,888 B2
(45) Date of Patent: May 10, 2011

(54) SYSTEMS AND METHODS FOR DEHUMIDIFICATION

(75) Inventor: Gad Assaf, Beer Sheva (IL)

(73) Assignee: Agam Energy Systems Ltd., Hod Hasharon (IL)

( * ) Notice: Subject to any disclaimer, the term of this patent is extended or adjusted under 35 U.S.C. 154(b) by 1076 days.

(21) Appl. No.: 11/632,250

(22) PCT Filed: Jul. 12, 2005

(86) PCT No.: PCT/IL2005/000766

§ 371 (c)(1),
(2), (4) Date: Jan. 10, 2007

(87) PCT Pub. No.: WO2006/006177

PCT Pub. Date: Jan. 19, 2006

(65) Prior Publication Data

US 2007/0234743 A1 Oct. 11, 2007

(30) Foreign Application Priority Data

Jul. 14, 2004 (IL) ..... 163015

(51) Int. Cl.
*B01D 53/14* (2006.01)

(52) U.S. Cl. ..... 95/179; 95/180; 95/193; 95/209; 95/228; 95/231

(58) Field of Classification Search ..... 95/172–180, 95/192–194, 208–209, 227–228, 231; 96/242; 62/94, 271

See application file for complete search history.

(56) References Cited

U.S. PATENT DOCUMENTS

| | | | | |
|---|---|---|---|---|
| 2,798,570 | A * | 7/1957 | Kelley | 95/18 |
| 4,205,529 | A * | 6/1980 | Ko | 62/235.1 |
| 4,355,683 | A * | 10/1982 | Griffiths | 165/60 |
| 4,905,479 | A * | 3/1990 | Wilkinson | 62/271 |
| 4,939,906 | A | 7/1990 | Spatz et al. | |
| 4,941,324 | A * | 7/1990 | Peterson et al. | 62/94 |
| 5,097,668 | A * | 3/1992 | Albers et al. | 62/94 |
| 5,129,925 | A * | 7/1992 | Marsala et al. | 96/242 |
| 6,018,954 | A * | 2/2000 | Assaf | 62/94 |
| 6,463,750 | B2 * | 10/2002 | Assaf | 62/271 |
| 7,306,650 | B2 * | 12/2007 | Slayzak et al. | 95/91 |
| 7,306,654 | B2 * | 12/2007 | King et al. | 95/224 |
| 2001/0015072 | A1 | 8/2001 | Assaf | |
| 2002/0116935 | A1 * | 8/2002 | Forkosh et al. | 62/93 |

FOREIGN PATENT DOCUMENTS

| | | |
|---|---|---|
| WO | WO 99/26025 | 5/1999 |
| WO | WO 03/004937 | 1/2003 |

* cited by examiner

*Primary Examiner* — Duane Smith
*Assistant Examiner* — Ives Wu
(74) *Attorney, Agent, or Firm* — Bachman & LaPointe, P.C.

(57) ABSTRACT

A liquid desiccant regenerator system, including a desiccant/air heat exchanger having a first desiccant inlet and a desiccant reservoir. The reservoir has a first desiccant outlet, a second desiccant outlet and a second desiccant inlet. The first desiccant inlet and the first desiccant outlet are connectable to a heat source, the second desiccant inlet conducts diluted desiccant of the reservoir and the second desiccant outlet conducts concentrated desiccant from the reservoir. The second desiccant inlet and the desiccant outlet are connected to a desiccant/desiccant heat exchanger for applying heat to the diluted desiccant flowing into the reservoir. A dehumidification method is also provided.

8 Claims, 2 Drawing Sheets

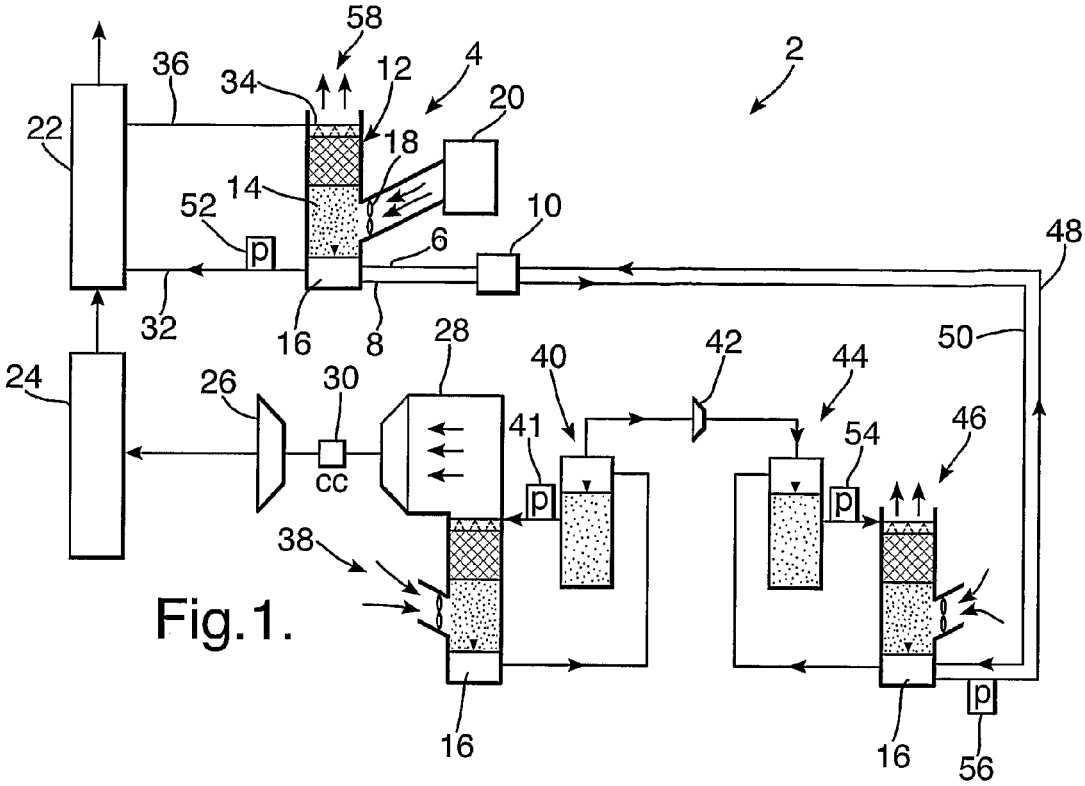
Fig.1.
Fig.2.
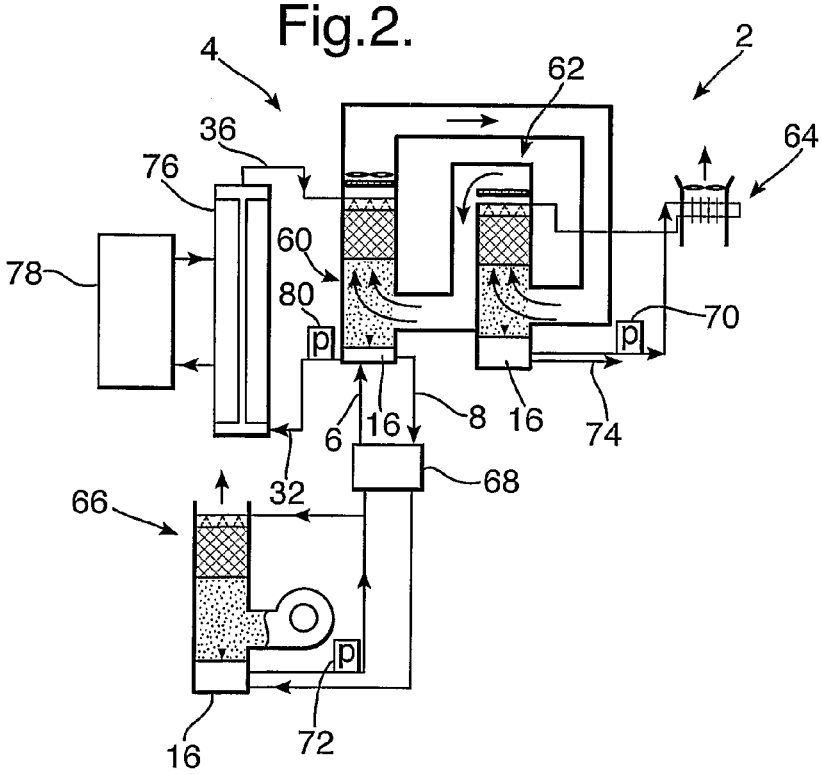

SYSTEMS AND METHODS FOR DEHUMIDIFICATION

FIELD OF THE INVENTION

The present invention relates to dehumidification systems and methods, and more particularly, to a liquid desiccant regenerator (LDR) for the dehumidification of air in an enclosure, and to a method for dehumidification.

BACKGROUND OF THE INVENTION

U.S. Pat. No. 6,266,975 discloses a desiccant (brine) regenerator based on a vapor compressor. The regeneration maintains the desiccant as a concentrate, since effective vapor sinks even in humid conditions. U.S. Pat. No. 6,463,750 discloses a system for dehumidification of air in an enclosure which includes an air/brine heat exchanger for heating cold fresh air introduced into the heat exchanger from the outside and for dehumidifying the air within the enclosure by vapor condensation.

SUMMARY OF THE INVENTION

In contradistinction to the above-described dehumidifying systems, the present invention is based on a regenerator which removes water from a water solution. Low grade waste heat can be effectively used for such a generator.

It is thus a broad object of the present invention to provide a regenerating system and method for dehumidification and a method based on a liquid desiccant by removing liquid from the desiccant, which is heated prior to contacting the air to be dehumidified within an enclosure.

In accordance with the present invention, there is therefore provided a liquid desiccant regenerator system, comprising desiccant/air heat exchanger having a first desiccant inlet and a desiccant reservoir; said reservoir having a first desiccant outlet, a second desiccant outlet and a second desiccant inlet; said first desiccant inlet and said first desiccant outlet being connectable to means for applying heat to said desiccant, and said second desiccant inlet conducting diluted desiccant to said reservoir and said second desiccant outlet conducting concentrated desiccant from said reservoir, said second desiccant inlet and said desiccant outlet being connected to a desiccant/desiccant heat exchanger for applying heat to the diluted desiccant flowing into said reservoir.

The invention further provides a dehumidification method, comprising providing a desiccant/air heat exchanger having a first desiccant inlet and a desiccant reservoir; said reservoir having a first desiccant outlet, a second desiccant outlet and a second desiccant inlet; said first desiccant inlet and said desiccant outlet being connectable to means for applying heat to said desiccant; said second desiccant inlet circulating diluted desiccant and said second desiccant outlet conducting desiccant to said reservoir and being connected to a desiccant/desiccant heat exchanger for applying heat to the diluted desiccant flowing into said reservoir, a and propelling the concentrated desiccant at a rate higher than the evaporation rate of water from the desiccant.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic, cross-sectional view of a regenerating system for dehumidification according to the present invention;

FIG. 2 is a schematic, cross-sectional view of another embodiment of a regenerating system for dehumidification according to the present invention;

FIG. 3 is a schematic, cross-sectional view of a two-stage system of the embodiment of FIG. 2, and FIG. 4 is a schematic, cross-sectional view of a further embodiment of a regenerating system for dehumidification according to the present invention.

DETAILED DESCRIPTION OF PREFERRED EMBODIMENTS

Figure 3:
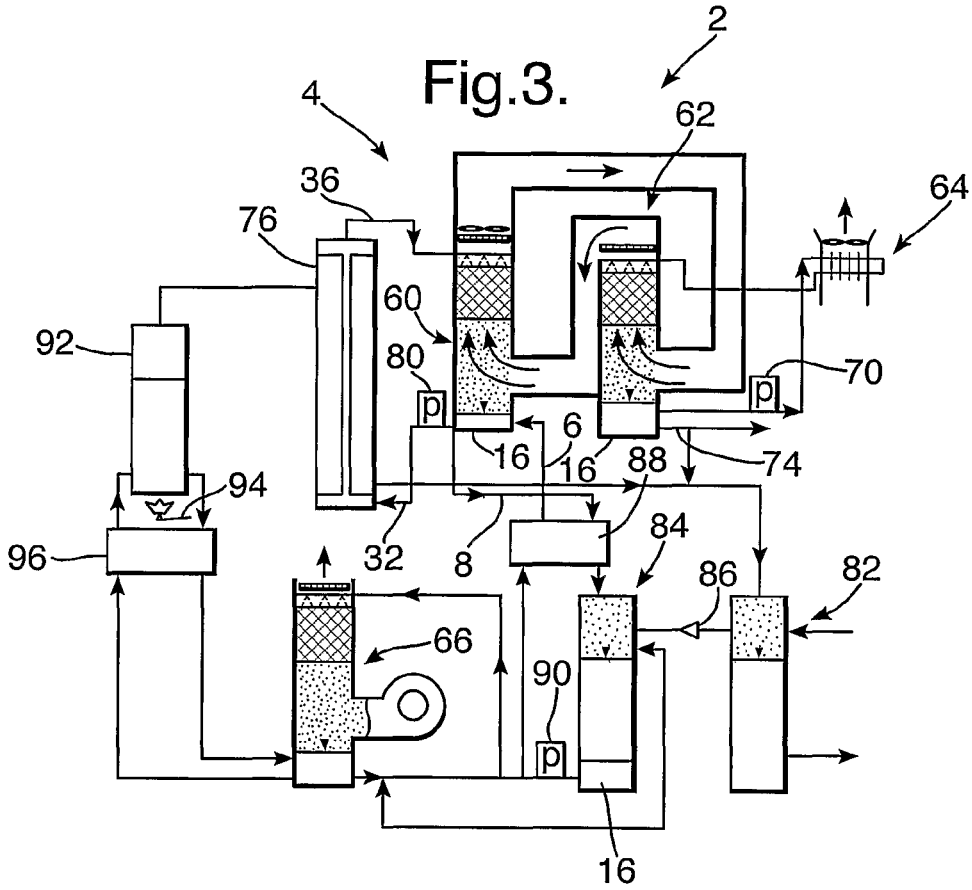

FIG. 1 illustrates a regenerating system 2 for dehumidification according to the present invention, which includes a liquid desiccant regenerator 4 having an inlet 6 for receiving a diluted liquid desiccant, e.g., brine, and an outlet 8 for exiting concentrated desiccant. Both inlet 6 and outlet 8 pass through a heat exchanger 10. As is per se known, e.g., from the above-mentioned U.S. Pat. Nos. 6,266,975 and 6,463,750, the teachings of which are incorporated herein by reference, the regenerator 4 is composed of an air/desiccant heat exchanger 12, a drip chamber 14, a desiccant reservoir 16 and a blower or fan 18, which introduces air into the drip chamber 14. The drip chamber 14 may optionally be provided with an air heater 20 for heating the air prior to its introduction into the drip chamber.

There is further provided a desiccant heater 22 receiving heat from a steam generator 24, which generator obtains gas from a turbine 26, and which, in turn, receives gas from a gas compressor 28 via a combustion chamber 30. The heater 22 is connected to the desiccant reservoir 16 via conduit 32, and to the desiccant inlet 34 via conduit 36. The gas compressor 28 is fed by air exiting from an air cooler 38 which is in fluid communication with a flash evaporator 40, via a pump 41. The flash evaporator 40 is operationally connected, via a vapor compressor 42, to a vapor desiccant condenser 44 and an atmospheric evaporator 46. The desiccant reservoirs 16 of regenerator 4 and the evaporator 46 are in fluid communication through conduits 48, 50 passing through the heat exchanger 10. Fluid propelling pumps 52, 54, 56 are also provided.

The desiccant regenerator 4 exchanges diluted desiccant flowing into the regenerator 4 via inlet 6 with concentrated desiccant discharging from regenerator 4 via outlet 8. The temperature of the concentrated desiccant is high, compared with that of the diluted desiccant, which introduces heat from regenerator 4 to vapor condenser 44. The heat elevates the temperature of the diluted desiccant, which functions as a vapor sink. The high temperature elevates the vapor pressure of the desiccant and reduces its effect as a vapor sink. When the desiccant exchange with the regenerator is too small, the desiccant concentration in the regenerator may become too high and the vapor pressure too small, in other words, the vapor pressure may be lower than the vapor pressure of the air in the regenerator. Such a situation will stop the regeneration process. Furthermore, at a low exchange rate, the concentration of the desiccant can become so high that the liquid can crystallize and stop its function.

Liquid desiccant is characterized by vapor pressure, which is low, compared with the vapor pressure of water at the same temperature. The ratio of desiccant vapor pressure to water pressure at the same temperature is defined as the "activity" $\alpha$. Thus, for example, the desiccant LiCl, at a concentration of S=25%, is characterized by vapor pressure which is half that of water at the same temperature and has an activity of $\alpha$=50%. At S=40%, the activity $\alpha$=25%.

Let $S_1$ be the diluted concentration of desiccant in the solution (kg salt/kg solution) and let $S_2$ be the desiccant concentration at the regenerator ($S_2>S_1$). If $M_1$ is the mass flow rate into the regenerator and $M_2$ is the desiccant discharge from the regenerator, and if E is the mass of vapor removal from the desiccant at the regenerator, then the mass balance of desiccant (salt) requires that $$M_1S_1=M_2S_2. \quad (1)$$

The total mass flux balance is:

$$M_1=M_2+E \quad (2)$$

Multiplying Equation 2 by $S_1$ and extracting from Equation 1, yields:

$$M_2(S_2-S_1)=ES_1, \text{ or } M_2=ES_1/(S_2-S_1) \quad (3)$$

Solving for $M_1$ yields:

$$M_1=ES_2/(S_2-S_1) \quad (4)$$

Figure 4:
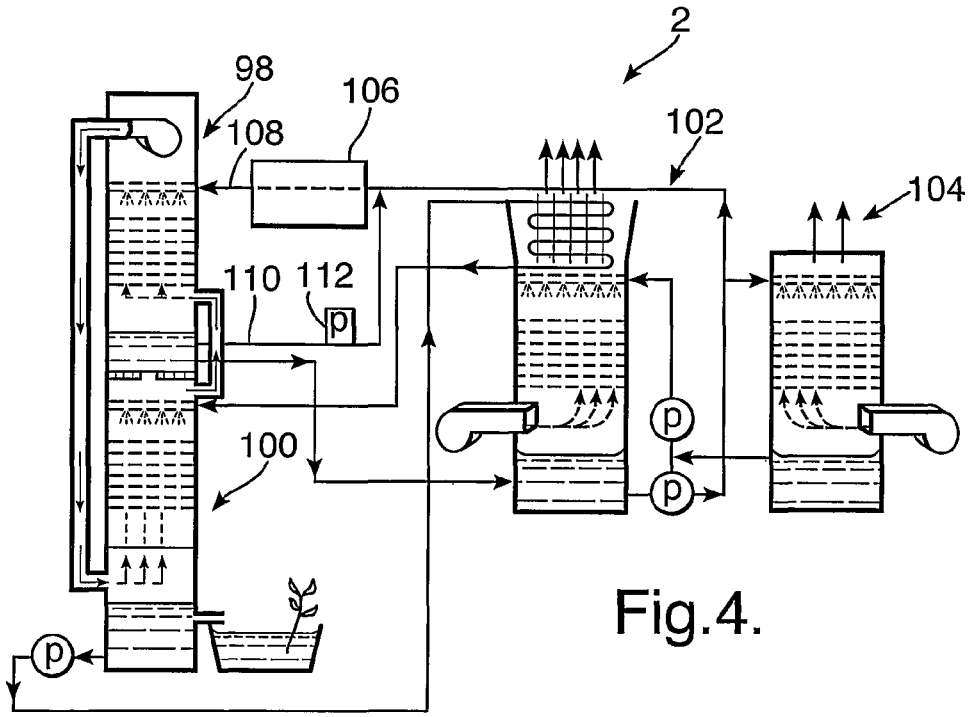

(with reference to the embodiments of FIGS. 2 and 4 only.)

To be in a steady state, E should be equal to the rate at which vapor is condensed on the desiccant, C=E=, e.g., 10 kg/hr at a relative humidity of 85% and a temperature of 18° C., which characterizes the conditions inside many greenhouses. The vapor content is W=11 g vapor/kg air.

To keep a greenhouse at the desired climate, it is required that the dehumidifier will remove the vapor load within the greenhouse. For example, in a given enclosure, the vapor load is 10 kg/hr or 2.78 g/s.

Three modes of dehumidification are recognized:

1) The desiccant enthalpy and temperature is large, compared with the enthalpy of the design air introduced to the unit. Desiccant enthalpy is defined as the enthalpy of air at the desiccant interface.
2) The desiccant enthalpy is the same as that of the air introduced into the air desiccant direct contact vapor condensers (enthalpy invariant exchange).
3) The desiccant enthalpy is lower than that of the air.

To be effective in cases (1) and (2) above, the desiccant activity $\alpha$ should be small, compared with the required relative humidity at the enclosure: $\alpha\alpha$<RH (Relative Humidity). In fact, the difference between RH and $\alpha$ should exceed 20%. If not, each kilogram of air will remove less than 1 gram of vapor, which would require a large air flow and large systems in order to remove the vapor load. This is expensive and power-consuming. Thus, in a dehumidifier installed in a greenhouse where DRH=85%, the activity of the diluted desiccant should be $\alpha\alpha$<65%. For lithium chloride, $S_1$>20%. For the same activity using CaCl desiccant, $S_1$>25%.

At the regenerator 4, the vapor pressure of the desiccant should be high, compared with that of the air introduced to the air desiccant heat exchangers embodied by the air cooler 38 and flash evaporator 40. The temperature of the desiccant is determined by the nature of the heat source. Thus, in regenerator 4, the chimney temperature at 58 (FIG. 1) is 60° C. and the desiccant temperature is 50° C. If the temperature of the air is 30° C. and RH=70%, the vapor pressure is 30mb. To allow evaporation, desiccant activity should exceed 25%, for LiCl desiccant, $S_2$<40%. At lower activity and a higher concentration, the desiccant will not evaporate at that temperature and the regenerator will not function.

Referring now to FIG. 2, there is illustrated a one-stage regenerator having a heat regenerating system 2. Shown is the regenerator 4, which is composed of a desiccant evaporator 60, a water vapor condenser 62, a water cooler/air heater 64 and a desiccant dehumidifier 66. The reservoirs 16 of desiccant dehumidifier 66 and evaporator 60 are in fluid communication via a desiccant-to-desiccant heat exchanger 68. Also provided are circulation pumps 70, 72 and a water outlet 74 discharging water from reservoir 16 of water vapor condenser 62. The desiccant evaporator 60 is connected via desiccant inlet conduit 36 and desiccant outlet conduit 38 to a desiccant heat exchanger 76 fed by a heater 78. A circulation pump 80, for propelling desiccant through the heat exchanger 76, is also provided.

A similar, two-stage regenerator is illustrated in FIG. 3. As can be seen, the second stage further includes a flash evaporator 82 in fluid communication with a desiccant vapor condenser 84 via a vapor compressor 86. The vapor condenser 84 is operationally interconnected with the reservoir 16 of the desiccant evaporator 60 via a heat exchanger 88. The fluid circulation between condenser 84 and evaporator 60 is effected by means of a pump 90, which also propels fluid to and from the desiccant dehumidifier 66. The heat exchanger 76 is in fluid communication with a desiccant boiler 92, which boiler is heated by a fuel burner 94. A heat exchanger 96 is also provided. The heat exchanger 76 utilizes steam from the desiccant boiler 92 to heat the desiccant in the evaporator 60.

Heat and vapor are recovered by water vapor condenser 62. The water transmits the heat to an enclosure by means of the air heater 64. The temperature of the water entering condenser 62 is usually 10° C. or so above the temperature of the enclosure, which is, e.g., 28° C. or more, for a greenhouse at 18° C. The water is heated at condenser 62 by about 10° C., and thus the water temperature varies between 28-38° C. The vapor pressure of water at 38° C. is 76 mb. At 28° C., the water vapor pressure is 38 mb. To allow the evaporation of desiccant in the evaporator 60, the vapor pressure of the desiccant should exceed the vapor pressure of the water at condenser 62.

The desiccant in the regenerator is heated by a hot water heater 78 (FIG. 2) or boiler 92 (FIG. 3) to a temperature of, e.g., 75° C. At that temperature, the desiccant's activity should be larger than 25% and the salinity, e.g., of LiCl, should be $S_2$<40%. In fact, for a CaCl brine at that activity, the liquid will crystallize.

For $S_1$>20% and $S_2$<40%, e.g., $S_1$=22% and $S_2$=38%, and for a vapor load of 10 kg/hr, Equation 4 is applied: $M_1=10*S_2/(S_2-S_1)$.

Thus, $M_1$=10*38/(38−22)=2.375*10=23.75 kg/hr.

The actual limit on the desiccant mass flow to the regenerator is: $M_1=ES_2/(S_{2_S1})$ For practically all applications, the regenerator concentration is $S_2<2S_1$, and therefore $M_1>2E$.

When the inflow into the regenerator does not exceed 2E, the desiccant will crystallize. The most active desiccant, such as LiBr, will work only at high temperature, which generate material deterioration inside the regenerator.

To increase the efficiency of the regenerator of the present invention, a heat exchanger 68 (FIG. 2), 88 (FIG. 3) is provided between the diluted desiccant and the concentrated desiccant flow.

Another embodiment of the invention is illustrated in FIG. 4. Shown is a desiccant regenerator 98, and an air-water condenser 100 operationally coupled to the regenerator. Also shown are heat exchangers 102, 104 in fluid communication with regenerator 98 and condenser 100. A heater 106 is connected to inlet 108 and outlet 110 of regenerator 98, for heating the desiccant in the regenerator. The heated desiccant is circulated at a preset rate by means of pump 112.

It has been determined that good results are obtained when the mass flow rate of the desiccant is larger than the mass of the humidified water, e.g., at least twice the mass of the evaporated water. Also, the air mass flux into the desiccant evaporator should exceed the desiccant evaporation by a factor of 10, and the circulation mass flow rate of the desiccant in the regenerator should be at least 10 times larger than the desiccant evaporation rate.

Furthermore, it should be noted that the relationship between the diluted desiccant flowing into the regenerator and the concentrated desiccant flowing out of the regenerator could be controlled by a circulating pump disposed in the system to propel the desiccant into the regenerator. Also, in order for the desiccant/air heat exchangers to be effective, the Reynolds number of air inside the filling substance used in the heat exchanger, should be smaller than 2000.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A dehumidification method, comprising:

providing a desiccant/air heat exchanger having a first desiccant inlet and a desiccant reservoir; said reservoir having a first desiccant outlet for conducting concentrated liquid desiccant, a second desiccant outlet for conducting concentrated liquid desiccant and a second desiccant inlet for receiving diluted desiccant; said first desiccant inlet and said first desiccant outlet being connectable to means for applying heat to said concentrated liquid desiccant, and said second desiccant inlet conducting diluted desiccant to said desiccant reservoir and said second desiccant outlet conducting concentrated liquid desiccant from said desiccant reservoir, said second desiccant inlet and said desiccant outlet being connected to a desiccant/desiccant heat exchanger for applying heat to the diluted desiccant flowing into said reservoir, and conveying the concentrated desiccant at a rate higher than the evaporation rate of water from the desiccant; said method further including:

pumping concentrated liquid desiccant from the desiccant reservoir to the heater and returning heated concentrated liquid desiccant from the heater to the first desiccant inlet at a rate such that the mass flow rate of the desiccant flow into the regenerator is at least twice the mass flow rate of the condensed water; and exposing the desiccant/air heat exchanger and the desiccant reservoir to air; whereby:

the desiccant regenerator exchanges diluted desiccant flowing into the regenerator via the inlet with concentrated desiccant discharging from the regenerator via the first desiccant outlet, the temperature of the concentrated desiccant is higher than the temperature of the diluted desiccant, so as to introduce heat from the regenerator to a vapor condenser, and the heat elevates the temperature of the diluted desiccant, which functions as a vapor sink.

2. The method as claimed in claim 1, further comprising the step of controlling the mass flow of the desiccant leaving the desiccant reservoir and returning to the desiccant reservoir to be at least 10 times higher than the evaporation rate of water.

3. The method as claimed in claim 1, said method further comprising the step of controlling the air mass flux into the desiccant/air evaporator to exceed the desiccant evaporation rate by a factor of at least 10.

4. The method as claimed in claim 3, wherein air exiting from said desiccant/air heat exchanger transmits heat and water vapour to a water vapour condenser, said heat being further transmitted from the water vapour condenser to an air enclosure via an air/water heat exchanger, wherein the air exiting from said water vapour condenser returns to said desiccant/air heat exchanger, thereby closing an air loop between the desiccant/air heat exchanger and said water vapour condenser.

5. The method as claimed in claim 1, for removing water condensed at a water vapour condenser and conveying condensed vapour through a vapour compressor to an evaporator.

6. A desiccant dehumidifier using the method as claimed in claim 1 to remove water from an desiccant.

7. The method as claimed in claim 1, further comprising the step of establishing a heat exchange relationship between the diluted desiccant flow into said desiccant reservoir and the concentrated desiccant flow out of said desiccant reservoir.

8. The method as claimed in claim 1, wherein in respect of air flowing through the desiccant/air heat exchanger the Reynolds number is smaller than 2000.

* * * * *